US005921814A

United States Patent [19]

Maruyama

[11] Patent Number: 5,921,814

[45] Date of Patent: Jul. 13, 1999

[54] SHIELDED BOARD MOUNTED ELECTRICAL CONNECTOR

[75] Inventor: Shinichiro Maruyama, Ayase, Japan

[73] Assignee: Molex Incorporated, Lisle, Ill.

[21] Appl. No.: 08/805,958

[22] Filed: Feb. 25, 1997

[30] Foreign Application Priority Data

Apr. 5, 1996 [JP] Japan ..... 8-110205

[51] Int. Cl.[6] ..... H01R 13/658

[52] U.S. Cl. ..... 439/607

[58] Field of Search ..... 439/607, 108, 439/95

[56] References Cited

U.S. PATENT DOCUMENTS

| | | | |
|---|---|---|---|
| 3,587,029 | 6/1971 | Knowles | 439/607 |
| 4,477,142 | 10/1984 | Cooper et al. | 339/125 R |
| 4,645,287 | 2/1987 | Olsson | 339/125 R |
| 4,708,412 | 11/1987 | Himes, Jr. et al. | 439/95 |
| 4,836,791 | 6/1989 | Grabbe et al. | 439/95 |
| 4,887,971 | 12/1989 | Beuss et al. | 439/98 |
| 4,889,502 | 12/1989 | Althouse et al. | 439/607 |
| 5,102,350 | 4/1992 | Janota et al. | 439/607 |
| 5,163,851 | 11/1992 | Hart et al. | 439/567 |
| 5,181,855 | 1/1993 | Mosquera et al. | 439/74 |
| 5,230,633 | 7/1993 | Hisatomi et al. | 439/79 |
| 5,352,135 | 10/1994 | Lenoir | 439/607 |
| 5,509,823 | 4/1996 | Harting et al. | 439/607 |
| 5,637,014 | 6/1997 | Sukegawa et al. | 439/607 |

FOREIGN PATENT DOCUMENTS

| | | |
|---|---|---|
| 524358 A2 | 1/1993 | European Pat. Off. . |
| 8-106961 | 4/1996 | Japan . |

*Primary Examiner*—Gary Paumen
*Assistant Examiner*—Tho D. Ta
*Attorney, Agent, or Firm*—James C. Paschall

[57] ABSTRACT

A shielded electrical connector includes a dielectric housing having a bottom wall and upstanding side walls defining a receptacle for receiving a plug portion of a complementary mating connector. A metallic shield is mounted on the housing and includes shield portions juxtaposed against the inside of the side walls of the receptacle. Bottom edges of the shield portions are disposed above the bottom wall of the receptacle. The bottom edges are uninterrupted along substantially the entire lengths of the shield portions. The bottom wall of the housing within the receptacle includes recessed areas adjacent the side walls for receiving the bottom edges of the shield portions. A pair of the connectors are joined in a given spacial relationship by a pair of connecting bars embracing dove-tail shaped attachment bosses projecting from the housings of the connectors.

10 Claims, 6 Drawing Sheets

SHIELDED BOARD MOUNTED ELECTRICAL CONNECTOR

FIELD OF THE INVENTION

This invention generally relates to the art of electrical connectors and, particularly, to a shielded electrical connector for surface mounting on a printed circuit board.

BACKGROUND OF THE INVENTION

A conventional shielded surface mount electrical connector includes a dielectric (plastic) housing having a plurality of terminal-receiving cavities or passages, with a plurality of terminals received in the passages. A metal shield surrounds a substantial portion of the housing to protect at least the mating portions of the terminals from RF and EMI interference as well as protecting the surroundings from interference radiating from the connector, itself. The housing is mounted to the surface of a printed circuit board, and the terminals have tail portions for surface mounting to circuit pads on the board. In some applications, the housing has no mounting feet or boardlocks extending into holes in the printed circuit board to secure it to the board.

In some systems for using a surface mount electrical connector as described above, the metal shield of the connector is grounded to ground circuit traces on the printed circuit board. In some applications, means are provided for polarizing the connector relative to the board to ensure proper orientation of the connector on the board. In other applications, the connectors are used in pairs, such as mating plug and receptacle connectors, both of which have protective metal shields which are commoned to each other when the connectors are mated. Further, the mating connectors both may be surface mounted to printed circuit boards to provide a board-to-board interconnection. Still other applications have a plurality of connectors mounted to one side of the same printed circuit board, and the connectors are joined by connecting bars or braces.

The present invention is directed to providing various improvements in surface mount electrical connectors, particularly shielded connectors of the character described. For instance, grounding pins on the metal shield of the connector are used to polarize the connector relative to the board, whereby the pins perform an efficient dual function of grounding the shield and polarizing the connector.

SUMMARY OF THE INVENTION

An object, therefore, of the invention is to provide a new and improved shielded surface mount electrical connector for mounting to a surface of a circuit board.

In the exemplary embodiment of the invention, the connector includes a dielectric housing having a bottom wall and upstanding side walls and end walls defining a receptacle for receiving a plug portion of a complementary mating connector. A metallic shield is mounted on the housing and includes shield portions juxtaposed against the inside of the side walls, the end walls and the corners therebetween of the receptacle. The bottom edges of the shield portions are disposed above the bottom wall of the receptacle, and the bottom edges are uninterrupted along substantially the entire lengths and widths of the shield portions.

As disclosed herein, the housing is elongated, and the shield portions are formed by plate portions of the shield. The bottom wall of the housing within the receptacle includes recessed areas adjacent the side walls and the end walls for receiving the bottom edges of the shield portions of the metallic shield. At least portions of the shield are folded over top edges of the side walls and include latches on the outside of the side walls for securing the shield to the housing.

Another feature of the invention is a system for joining a pair of electrical connectors whereby the connectors can be conjointly mounted at a given spacial relationship on a supporting substrate. Each connector includes a dielectric housing having an attachment boss defined by at least one dove-tail shaped portion projecting from the housing. A connecting bar joins the pair of electrical connectors. The bar has opposite distal ends embracing the dove-tail shaped portions of the attachment bosses projecting from the housings of the connectors.

Preferably, the connecting bar is molded of plastic material, and the opposite distal ends of the connecting bar are overmolded about the dove-tail shaped portions of the attachment bosses. In the preferred embodiment, the housings of the pair of electrical connectors are elongated, with one of the attachment bosses near each opposite end of each housing, and a pair of the connecting bars join the opposite ends of the respective housings. As disclosed herein, each attachment boss includes a pair of the dove-tail shaped portions offset relative to each other longitudinally of the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 2:
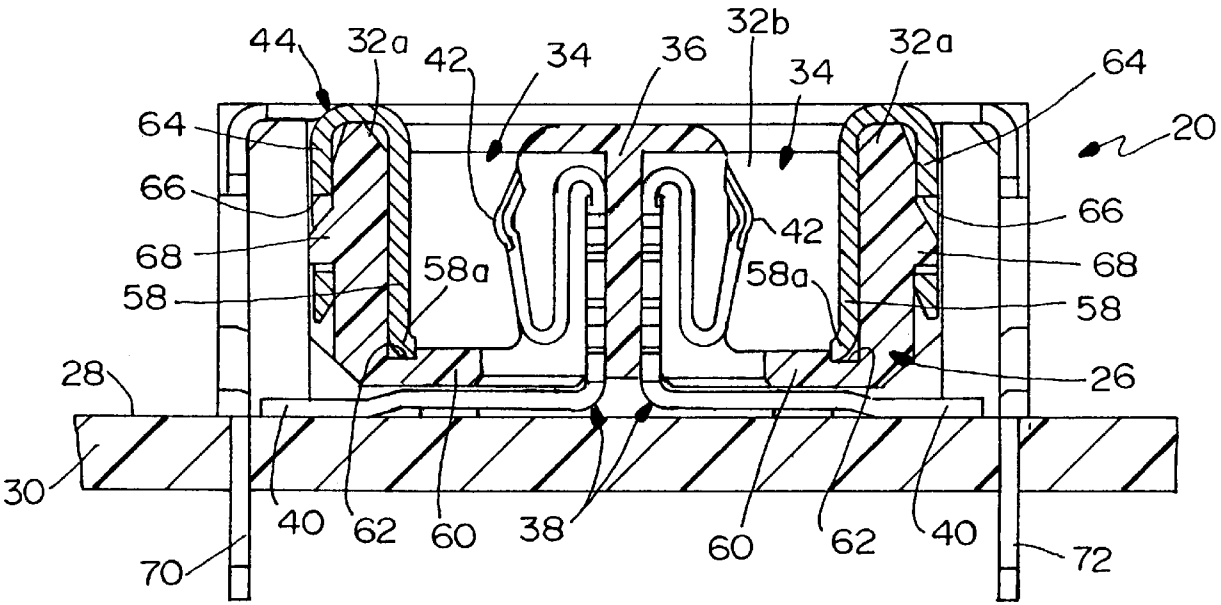
FIG. 2 is a vertical section, on an enlarged scale, taken generally along line 2—2 of FIG. 1.

Referring to the drawings in greater detail, the features of the invention are shown in an electrical connector assembly which includes a receptacle connector, generally designated 20 and a mating plug connector, generally designated 22. Receptacle connector 20 is shown in FIGS. 1–5, and mating plug connector 22 is shown in FIGS. 6–10. An alternate embodiment of a receptacle connector, generally designated 24 is shown in FIGS. 11–14.

More particularly, receptacle connector 20 includes an elongated dielectric housing, generally designated 26, adapted for mounting to a top surface 28 (FIG. 2) of a printed circuit board 30. Housing 26 includes a mating portion defined by a pair of long side walls 32*a* which extend generally parallel to each other in the longitudinal direction of the housing and a pair of short end walls 32*b* which extend generally parallel to each other in the lateral direction of the housing 26. The side and end walls define an elongated plug-receiving slot or receptacle 34 therebetween, the slot being divided longitudinally by a central partition 36.

As best seen in FIG. 2, two rows of terminals, generally designated 38, are mounted in spaced arrays longitudinally of dielectric housing 26. Each terminal 38 includes a tail portion or foot 40 for surface interconnection, as by soldering, to appropriate circuit traces on surface 28 of circuit board 30. The feet 40 of the terminals in each row project laterally outwardly away from the feet of the terminals in the other row on the opposite side of the central partition 36 of the dielectric housing 26. Separating blocks 43 descend from the bottom of the housing between adjacent tail portions 40 to separate the tail portions 40 and support the housing 26. The terminals in the two rows have resilient contact portions 42 which project laterally outwardly into the plug-receiving slot 34 on opposite sides of central partition 36 of the housing.

Figure 3:
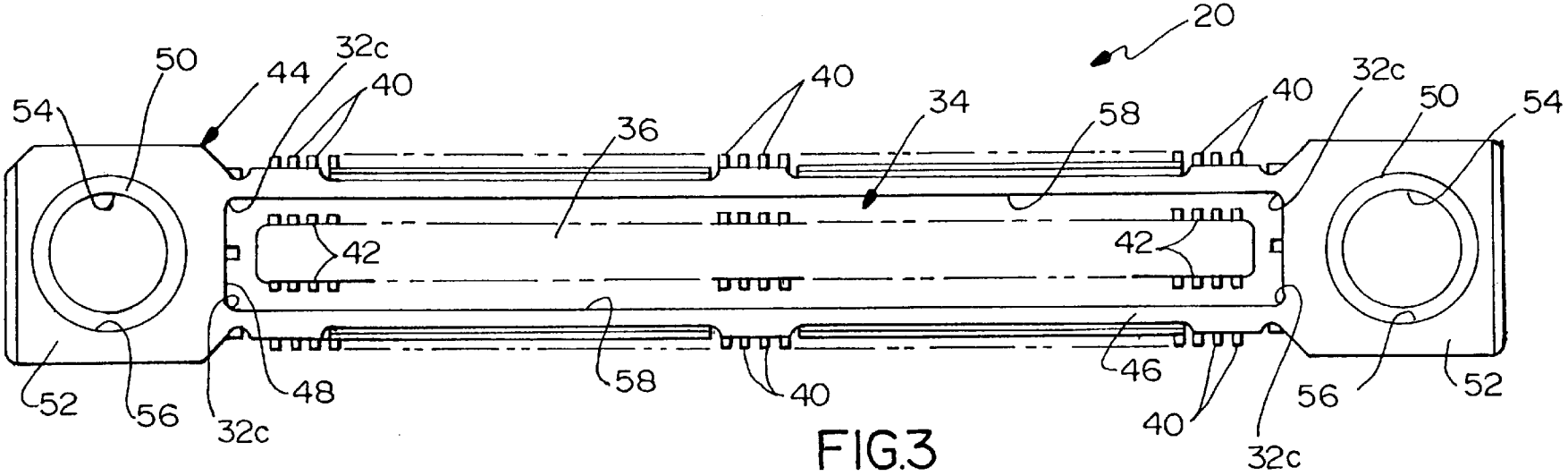
FIG. 3 is a top plan view of the receptacle connector.
Figure 5:
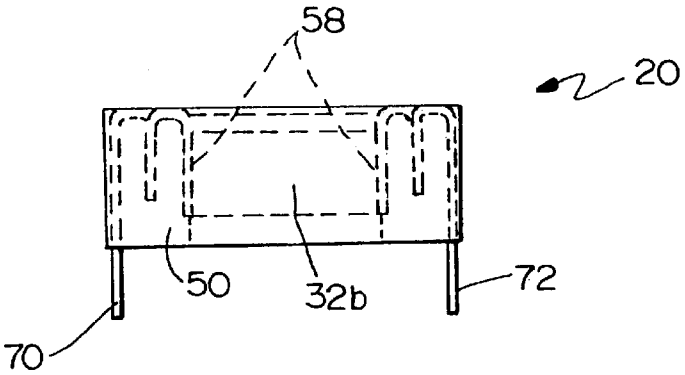
FIG. 5 is an end elevational view of the receptacle connector.

Receptacle connector 20 also includes a one-piece conductive shield, generally designated 44, stamped and formed of sheet metal material. As best seen in FIG. 3, metal shield 44 includes a top flat plate portion 46 which overlies substantially the entire top flat surface of the dielectric housing, except for central partition 36. The shield is provided with an elongated opening 48 (FIG. 3) which coincides with plug-receiving slot 34 of the housing. The housing has opposite ends 50 (FIG. 1) extending outwardly beyond the central mating portion of the housing, and shield 44 has end wing portions 52 (FIG. 3) which overlie end portions 50 of the housing. As seen best in FIG. 3, end portions 50 of the housing include locating holes 54 for purposes described hereinafter, and wing portions 52 of the shield have holes; 56 concentric with holes 54 in the housing.

As best seen in FIG. 2, metal shield 44 has plate portions 58 juxtaposed against the inside of long side walls 32*a* and short end walls 32*b* of the dielectric housing. The shield 44 also bends around the corners 32*c* adjoining the long side walls 32*a* and the short end walls 32*b* to provide a closed loop around the plug-receiving slot 34. Bottom edges 58*a* of the plate portions are disposed above a bottom wall 60 of the housing. The bottom edges of the plate portions are uninterrupted along substantially the entire lengths thereof which run substantially the entire length of the long walls 32*a* and the entire widths thereof which run substantially the entire width of the short end walls 32*b* of the plug-receiving slot 34 as seen in FIG. 3. Consequently, the bottom edges 58*a* of the plate portions 58 comprise a closed loop along the bottom wall 60. The bottom wall 60 of dielectric housing 26 has recessed areas 62 adjacent side walls 32 for receiving bottom edges 58*a* of plate portions 58 of the metallic shield. Therefore, the plate portions cannot deform inwardly into plug-receiving slot 34 where they might interfere with insertion of the plug connector 22.

Figure 1:
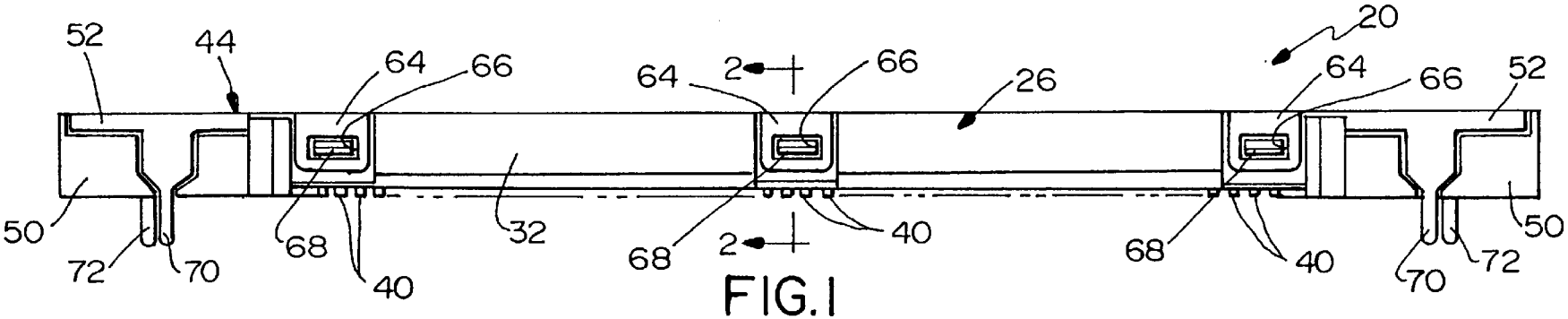
FIG. 1 is a side elevational view of the receptacle connector of the connector assembly according to the invention.

As best seen in FIGS. 1 and 2, the metallic shield 44 has three locking tabs 64 bent: over the tops of each long side wall 32*a* and downwardly within respective recesses in the outside surfaces of each long side wall. These locking tabs 64 have holes 66 for snapping over latch bosses 68 projecting outwardly from side walls 32 of the housing to lock the metal shield to the housing.

Figure 4:
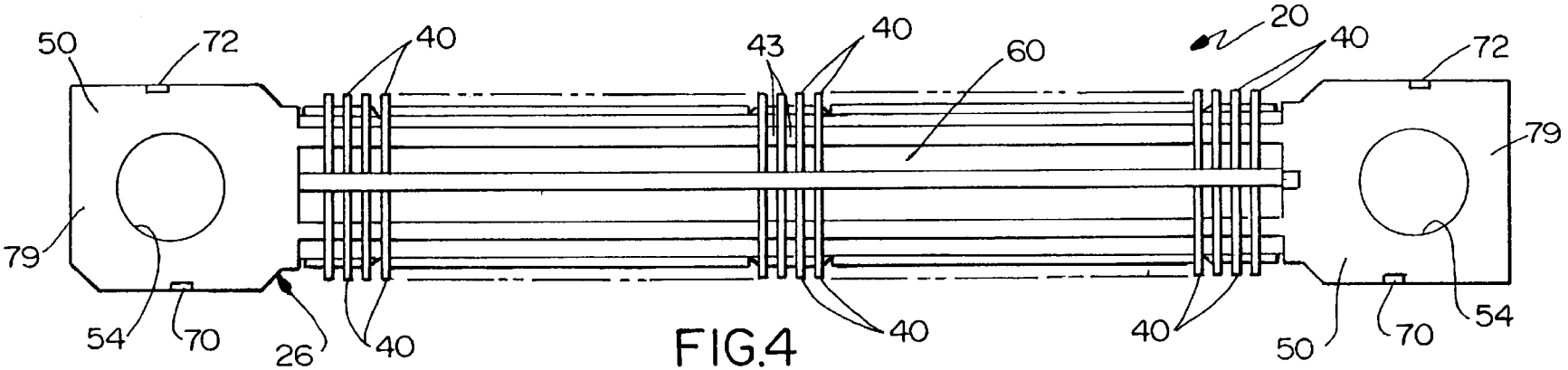
FIG. 4 is a bottom plan view of the receptacle connector.

As best seen in FIG. 1, the wing portion 52 of the shield 44 bend over and nest within respective recesses in opposite side walls of each end 50. Two pairs of integral grounding pins 70 and 72 depending from the wing portions 52 nest within respective recesses in the outside of end portions 50 of the dielectric housing. Referring to FIG. 4 in conjunction with FIGS. 1 and 2, one pair of grounding pins 70 is located on one side of the connector, and the other pair of grounding pins 72 are located on the opposite side of the connector. As seen in FIGS. 1 and 4, grounding pins 70 on the one side of the connector are closer to each other in the longitudinal direction than the grounding pins 72 on the opposite side of the connector. Therefore, with the two pairs of grounding pins being at different nonsymmetrical positions, a polarization feature is provided when the pins are insertable into complementarily positioned holes in circuit board 30. Therefore, grounding pins 70 and 72 perform a dual function of grounding metallic shield 44 of receptacle connector 20 to appropriate ground circuit traces on the circuit board as well as polarizing the connector relative to the board.

Figure 8:
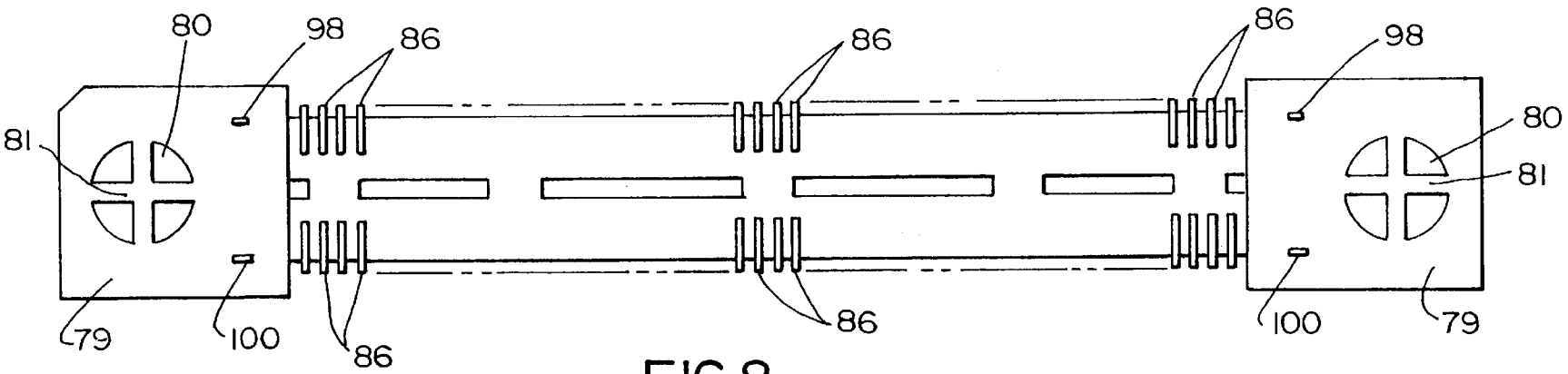
FIG. 8 is a bottom plan view of the plug connector.
Figure 6:
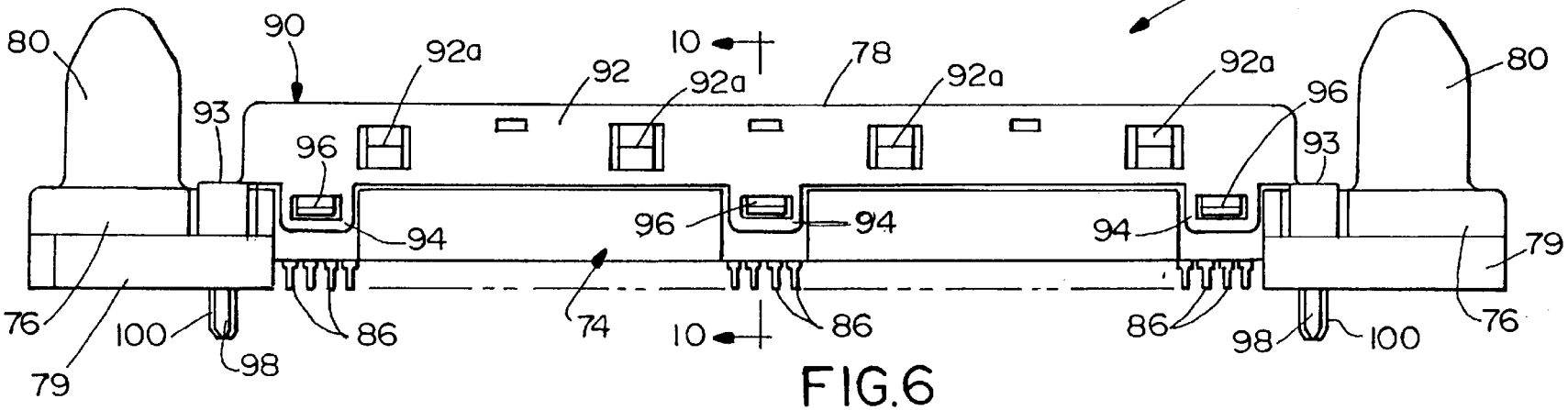
FIG. 6 is a side elevational view of the plug connector of the connector assembly according to the invention.
Figure 7:
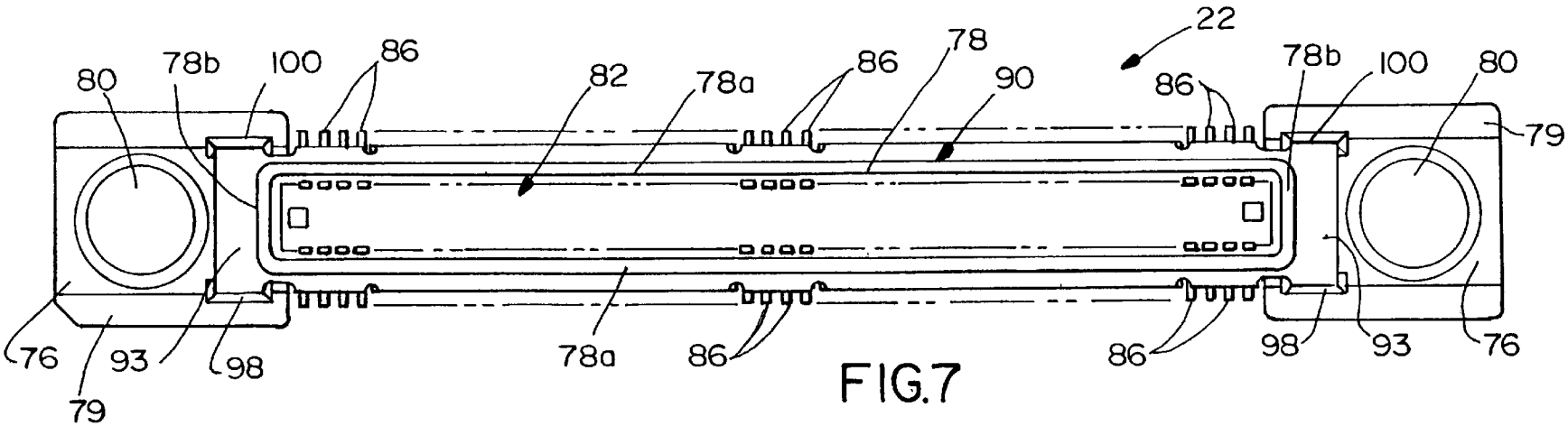
FIG. 7 is a top plan view of the plug connector.
Figure 9:
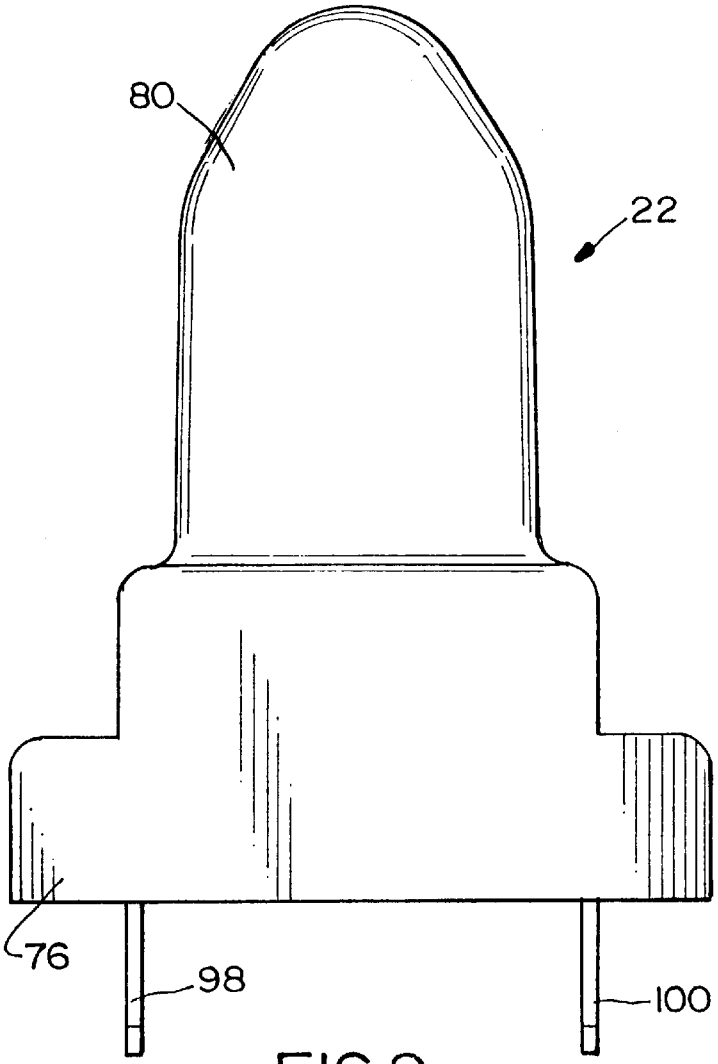
FIG. 9 is an end elevational view, on an enlarged scale, of the plug connector.
Figure 10:
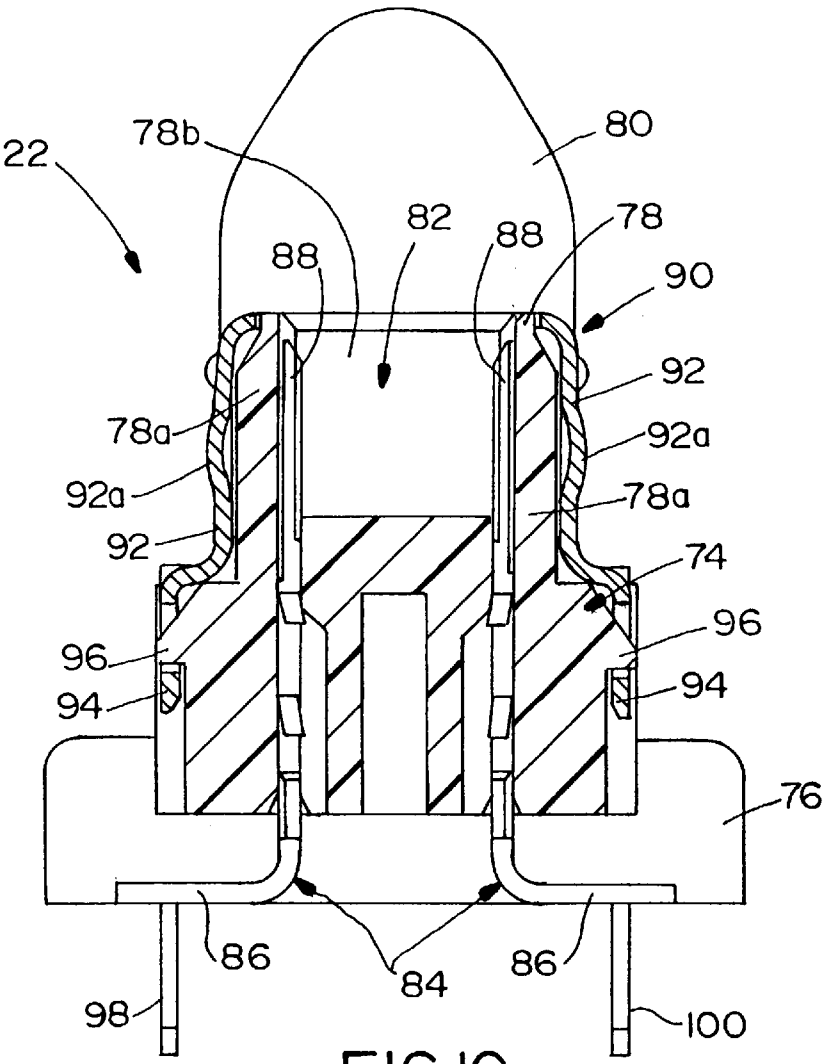
FIG. 10 is a vertical section, on an enlarged scale, of the plug connector, taken generally along line 10—10 of FIG. 6.

As stated above, plug connector 22 is shown in FIGS. 6–10. Like receptacle connector 20, plug connector 22 includes an elongated dielectric housing, generally designated 74, molded of plastic material or the like. The housing includes opposite end portions 76 extending longitudinally outwardly from a central mating portion 78. Each end portion 76 is supported by a, base 79 which is wider and lower on the housing than the central mating portion 78. As seen in FIG. 6, a pair of locating posts 80 project from end portions 76 for insertion into locating holes 54 (FIG. 3) of receptacle connector 20. As seen in FIG. 8, the locating posts 80 are hollow and include crossed baffles 81 to prevent the posts 80 from shrinking upon molding. As best seen in FIGS. 7 and 10, the mating portion 78 of plug connector 22 comprises two parallel long walls 78*a* traversed by two parallel short walls 78*b* to define a generally hollow, elongated opening, generally designated 82, for receiving central partition 36 (FIG. 2) and contact portions 42 of receptacle connector 20.

As best in FIG. 10, two rows of terminals, generally designated 84, are mounted in housing 74 of plug connector 22. Each terminal has a tail portion or foot 86 for surface interconnection to circuit traces on a printed circuit board, as by soldering. The two rows of terminals have two rows of contact portions 8SE spaced along the inside surfaces of mating portion 78, on opposite sides of opening 82 for engaging resilient contact portions 42 (FIG. 2) of terminals 38 of receptacle connector 20. When plug connector 22 is mated with receptacle connector 20, mating portion 78 of the plug connector is inserted into plug-receiving slot 34 of the receptacle connector, as central partition 36 and contact portions 42 of the receptacle connector enter opening 82 of the plug connector.

The plug connector 22 includes a one-piece metallic shield, generally designated 90, which substantially surrounds the mating portion 78 of the housing 74 of the plug connector. The metallic shield has elongated plate portions 92 (FIG. 6) juxtaposed along the outside surfaces of mating portion 78 as best seen in FIG. 10. The plate portions 92 are juxtaposed along the long walls 78*a* and the short walls 78*b* and bend around the adjoining corners therebetween to define a closed loop as shown in FIG. 7. The plate portions are joined to opposite end wing portions 93 (FIG. 7) juxtaposed over end portions 76 of the housing. Plate portions 92 have convex protrusions 92*a* which provide a positive engagement with plate portions 58 (FIG. 2) of metallic shield 44 of receptacle connector 20 when the plug and receptacle connectors are mated.

Similar to metallic shield 44 of the receptacle connector, metallic shield 90 of plug connector 22 has three locking tabs 94 on each long side which snappingly engage latch bosses 96 on the long walls 78*a* of the housing 74 as best seen in FIG. 6. This securely fixes the shield to the housing.

Like metallic shield 44 of receptacle connector 20, metallic shield 90 of plug connector 22 has two pairs of integral grounding pins 98 and 100 on opposite sides of the shield and the connector. One pair of grounding pins 98 are located on one side of the connector and the other pair of grounding pins 100 are located on the opposite side of the connector. Each pin 98, 100 descends along the end portion 76 and through a slot in the base 79. As best seen in FIGS. 6 and 8, the grounding pins are in alignment transversely of the connector, but the one pair of grounding pins 98 are narrower than the other pair of grounding pins 100. Therefore, these integral grounding pins of different sizes are insertable into complementarily sized holes in the printed circuit board to provide polarization of the connector on the board. Again, the pins thereby perform a dual function of grounding the metallic shield as well as polarizing the connector.

Figure 11:
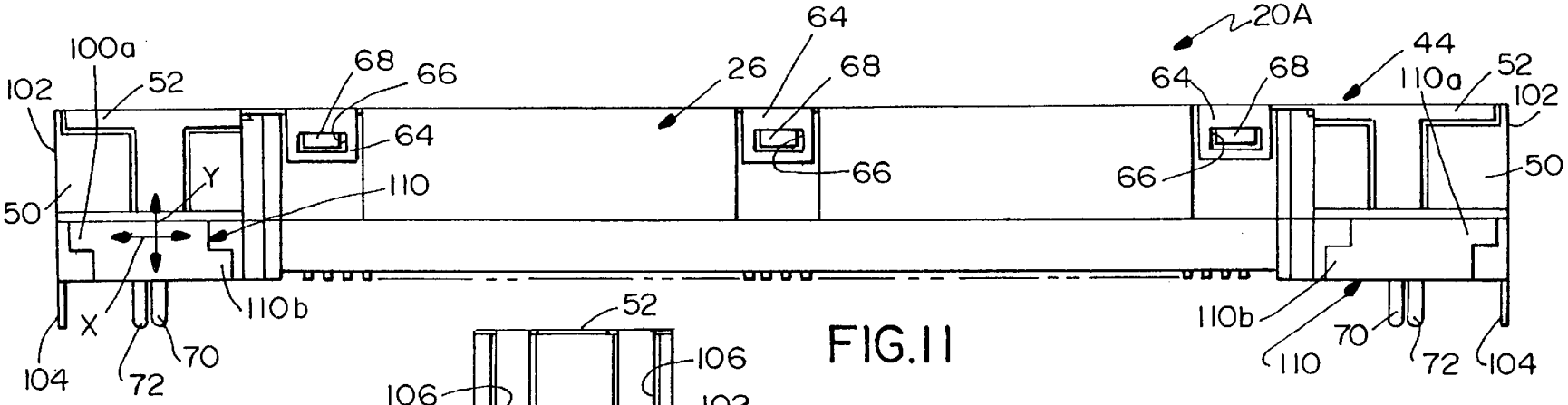
FIG. 11 is a side elevational view of an alternate embodiment of the receptacle connector.
Figure 13:
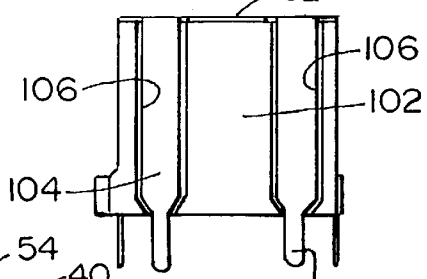
FIG. 13 is an end elevational view of the receptacle connector of FIG. 11.

FIGS. 11–14 show an alternate embodiment of a receptacle connector, generally designated 20A which is generally similar to receptacle connector 20 in FIGS. 1–5. Therefore, like reference numerals have been applied in FIGS. 11–14 corresponding to like components shown in FIGS. 1–5 and described above. Receptacle connector 20A (FIGS. 11–14) differs from receptacle connector 20 (FIGS. 1–5) in two areas. First, as best seen in FIGS. 11 and 13, dielectric housing 26 has end walls 102 at the extreme opposite ends of the connector. A pair of auxiliary grounding pins 104 are embedded within a pair of slots 106 in each end wall 102 of the housing. Therefore, four additional grounding pins are provided for metallic shield 44 to further enhance the grounding system of the connector assembly.

Figure 14:
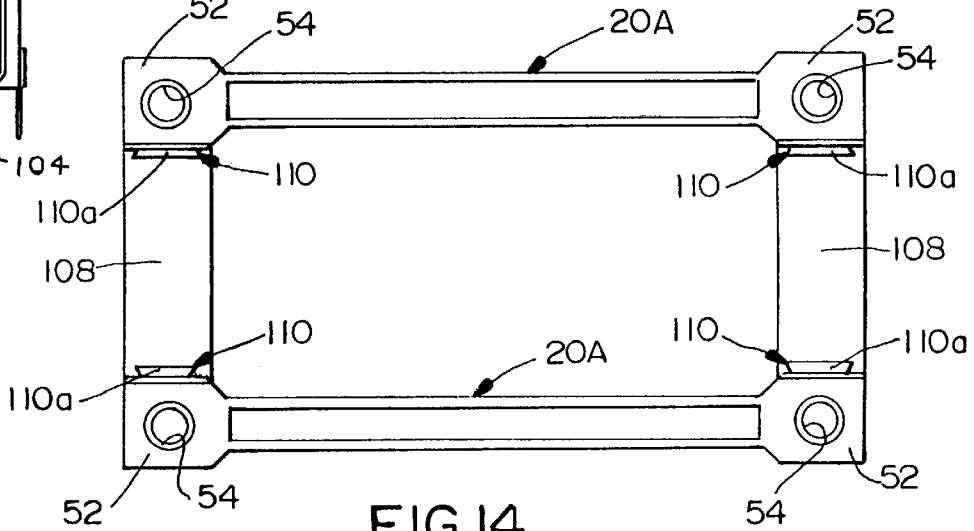
FIG. 14 is a top plan view, on a reduced scale, of a pair of the receptacle connectors of FIG. 11 joined in a parallel arrangement by a pair of connecting bars.

A second difference between receptacle connector 20A (FIGS. 11–14) and receptacle connector 20 (FIGS. 1–5) is the provision of means for facilitating rigidly interconnecting a pair of connectors 20A in a mutually parallel array as shown in FIG. 14. The pair of connectors 20A in FIG. 14 are joined by a pair of connecting bars 108. In order to fix connecting bars 108 between adjacent opposite ends of the two parallel connectors, attachment bosses, generally designated 110, are molded integrally with housing 26 and project from one side thereof at each opposite end portion 50 of the housing. It is contemplated that connecting bars 108 be molded of dielectric material such as plastic or the like, and that the ends of the connecting bars be overmolded about the preformed attachment bosses 110 which are molded integrally with dielectric housing 26. The attachment bosses have a unique configuration to provide support for connecting bars 108 in all directions.

Figure 12:
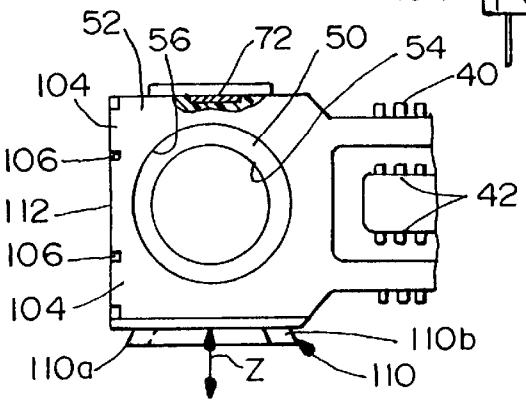
FIG. 12 is a fragmented top plan view of the left-hand end of the receptacle connector shown in FIG. 11.

More particularly, each attachment boss 110 has an upper dove-tail portion 110*a* and a lower dove-tail portion 110*b* as seen clearly in FIGS. 11 and 12. The dove-tail portions are offset longitudinally of the connector.

In order to understand the omni-directional support provided by attachment bosses 110, double-headed arrows "X" and "Y" are shown at the left-hand end of the connector in FIG. 11, and a double-headed arrow "Z" is shown in FIG. 12. Arrow "X" represents the horizontal direction longitudinally of the connector. Arrow "Y" represents the vertical direction. Arrow "Z" represents the horizontal direction transversely of the connector. Therefore, when connecting bars 108 are overmolded about the attachment bosses, the bosses obviously provide support in the horizontal longitudinal direction "X" simply because the attachment bosses project outwardly from the connector. The bosses provide support in the vertical "Y" direction because the dove-tail portions 110*a* and 110*b* are offset horizontally to provide vertical shoulders. The bosses provide support in the horizontal transverse direction "Z" because of the their dove-tailed configuration as seen best in FIGS. 12 and 14.

Therefore, connecting bars 108 are effective to maintain connectors 20A in precise parallel spacing along their entire lengths. With the connectors interconnected by the bars, the connectors can be conjointly mounted on the circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A shielded electrical connector, comprising:

a dielectric housing including a bottom wall and upstanding side walls defining a receptacle for receiving a plug portion of a complementary mating connector; and a metallic shield mounted on the housing and including shield portions juxtaposed against the inside of the side walls of said receptacle, with bottom edges of the shield portions disposed above a top surface of the bottom wall of the receptacle, the bottom edges being uninterrupted along and extending substantially along the entire lengths of the shield portions.

2. The shielded electrical connector of claim 1 wherein said housing and side walls are elongated, and said shield portions comprise plate portions of the shield.

3. The shielded electrical connector of claim 1 wherein the bottom wall of said housing within the receptacle includes recessed areas adjacent the side walls for receiving the bottom edges of the shield portions of the metallic shield.

4. The shielded electrical connector of claim 3 wherein at least portions of said shield are folded over top edges of said side walls and include tabs for engaging latches on the outside of the side walls for securing the shield to the housing.

5. The shielded electrical connector of claim 1 wherein said dielectric housing includes upstanding end walls traversing said upstanding sidewalls defining corners adjoining adjacent side walls and end walls, said shield portions also being juxtaposed against the inside of said end walls and the inside of said corners, bottom edges of the shield portions also being disposed above the bottom wall of the receptacle along the end walls and the corners, and being uninterrupted along substantially the entire lengths of the shield portions juxtaposed against the side walls, the end walls and the corners therebetween to provide a closed loop.

6. The shielded electrical connector of claim 5 wherein the bottom wall of said housing within the receptacle includes recessed areas adjacent the side walls, the end walls and the corners for receiving the bottom edges of the shield portions of the metallic shield.

7. A shielded electrical connector, comprising:

a dielectric housing including a bottom wall and upstanding side walls defining a receptacle for receiving a plug portion of a complementary mating connector;

a metallic shield mounted on the housing and including shield portions juxtaposed against the inside of the side walls of said receptacle, said shield portions including bottom edges; and the bottom wall of the housing within the receptacle including recessed areas adjacent the side walls for receiving said bottom edges of the shield portions of the metallic shield.

8. The shielded electrical connector of claim 7 wherein said recessed areas comprise troughs at the juncture between the bottom wall and the side walls of the receptacle.

9. The shielded electrical connector of claim 7 wherein at least portions of said shield are folded over top edges of said side walls and include tabs for engaging latches on the outside of the side walls for securing the shield to the housing.

10. A shielded electrical connector, comprising:

a dielectric housing including a bottom wall with side walls and end walls extending from the bottom wall to define a receptacle for receiving a plug portion of a complementary mating connector; and a metallic shield mounted on the housing and including planar shield portions juxtaposed against the inside of the side walls and end walls of said receptacle, the shield being uninterrupted along substantially the entire length of each of the shield portions.

* * * * *